US005971299A

United States Patent [19]

Loschelder et al.

[11] Patent Number: 5,971,299

[45] Date of Patent: Oct. 26, 1999

[54] KITCHEN FAUCET SIDE SPRAY

[75] Inventors: Todd C. Loschelder, Macedonia; Eduardo E. Milrud, Chagrin Falls; Thomas J. Overberg, North Olmsted; Vance M. Johnson, Amherst, all of Ohio

[73] Assignee: Moen Incorporated, North Olmsted, Ohio

[21] Appl. No.: 09/008,021

[22] Filed: Jan. 16, 1998

Related U.S. Application Data

[63] Continuation-in-part of application No. 08/786,639, Jan. 21, 1997, Pat. No. 5,806,771.

[51] Int. Cl.[6] ..... B05B 7/02

[52] U.S. Cl. ..... 239/526; 239/106; 239/553; 239/562; 239/DIG. 19; 222/571

[58] Field of Search ..... 239/104, 106, 239/119, 120, 525, 526, 530, 548, 562, 569, 579, 553, 553.3, 553.5, DIG. 19, 443, 446, 449, 583; 222/571; 251/321

[56] References Cited

U.S. PATENT DOCUMENTS

| | | | |
|---|---|---|---|
| 3,415,454 | 12/1968 | Bucknell et al. | 239/562 |
| 3,498,546 | 3/1970 | Logan et al. | 222/571 X |
| 3,588,040 | 6/1971 | Ward | 251/321 X |
| 4,187,986 | 2/1980 | Petrovic | 239/449 |
| 4,396,156 | 8/1983 | Southworth et al. | 239/526 |
| 4,607,764 | 8/1986 | Christine | 222/571 X |
| 4,629,124 | 12/1986 | Gruber . | |
| 4,703,893 | 11/1987 | Gruber . | |
| 5,100,055 | 3/1992 | Rokitenetz et al. | 239/525 X |
| 5,145,114 | 9/1992 | Monch . | |
| 5,158,234 | 10/1992 | Magnenat et al. . | |
| 5,184,777 | 2/1993 | Magnenat et al. . | |
| 5,323,968 | 6/1994 | Kingston et al. . | |
| 5,348,231 | 9/1994 | Arnold et al. . | |
| 5,383,604 | 1/1995 | Boesch . | |

*Primary Examiner*—Andres Kashnikow
*Assistant Examiner*—Steven J. Ganey
*Attorney, Agent, or Firm*—Dorn, McEachran, Jambor & Keating

[57] ABSTRACT

A spray device for use as an alternate water discharge to a faucet has a body with a handle and a spray head. The spray head has discharge openings therein. There is a trigger movable on the body between an off position and an on position. There is a chamber within the body which is in communication with a source of water under pressure and there is a water passage between the chamber and the discharge openings. A valve is movable within the chamber in response to movement of the trigger to connect the source of water under pressure through the chamber, to the water passage, and then to the discharge openings. The water passage is formed between closely spaced facing walls having a textured surface thereon to create adequate surface tension with water within the water passage, whereby water therein will not move to the discharge openings unless the water passage is connected to the source of water under pressure.

11 Claims, 2 Drawing Sheets

Fig. 2.
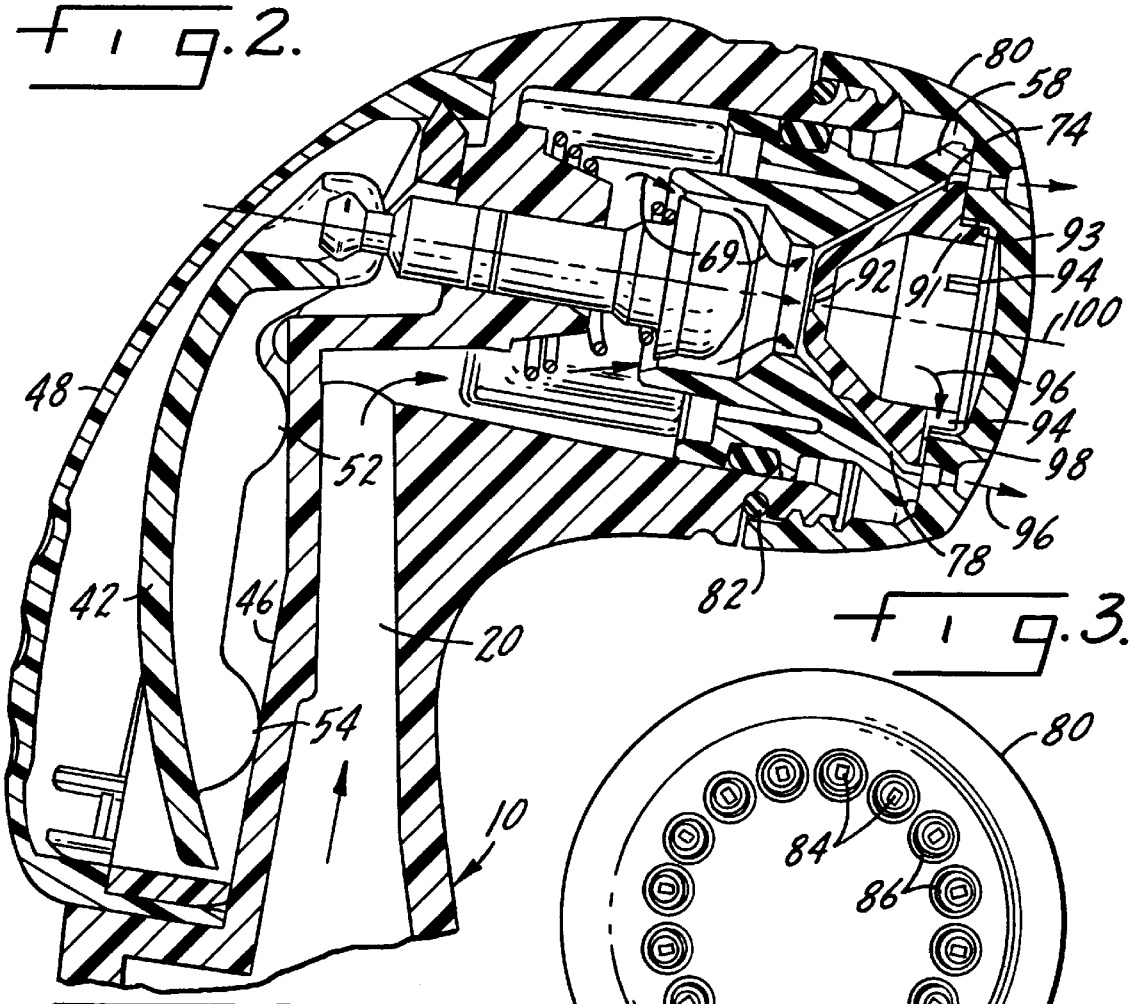
Fig. 3.
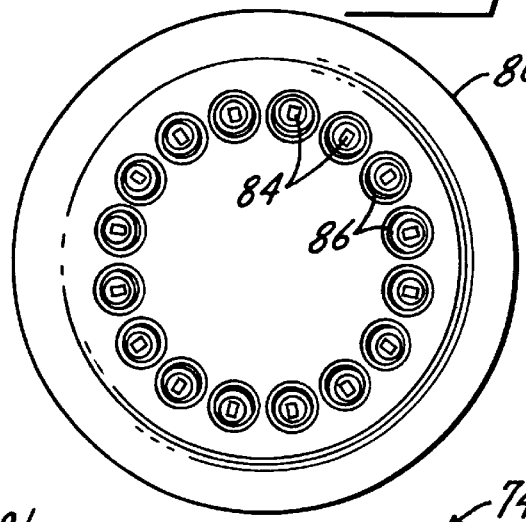
Fig. 5.
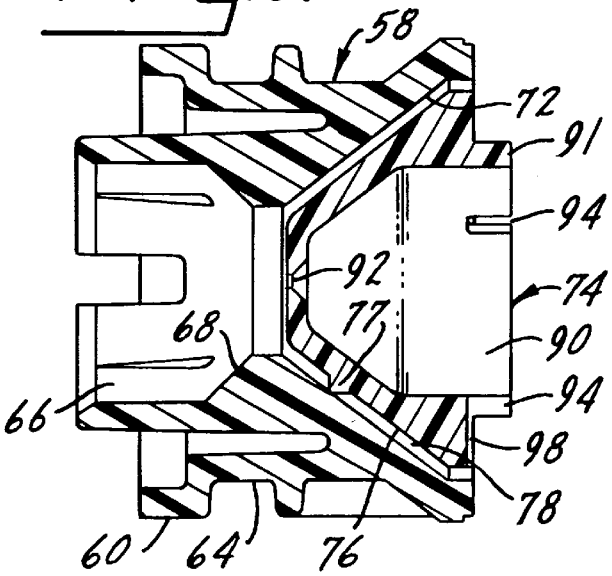
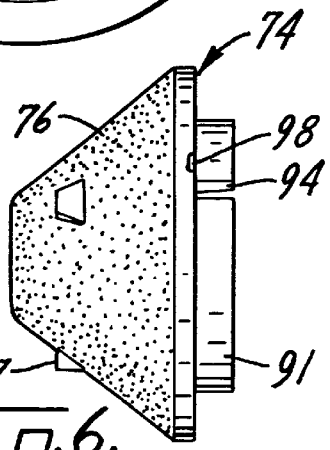
Fig. 6.

KITCHEN FAUCET SIDE SPRAY

RELATED APPLICATIONS

This application is a continuation-in-part of application Ser. No. 08/786,639, filed Jan. 21, 1997, now U.S. Pat. No. 5,806,771.

THE FIELD OF THE INVENTION

The present invention relates to a side spray of the type commonly used with a kitchen faucet. Normally, such a spray will be mounted on the end of a flexible hose and is operable, as an alternate discharge, when the faucet is in an "on" position. Customarily, such sprays are used to access areas of the kitchen sink normally not reachable by the faucet spout discharge. In the past, such side sprays, as they are termed in the art, have had a problem with water dripping from the discharge openings of the side spray, even after the water has been turned off. The present invention provides a side spray in which the dripping problem has been eliminated and in which the angle between the spray head and the handle is less than 90 degrees, which makes for a side spray which is more efficient in use and more ergonomically acceptable to a faucet user. In the past, most side sprays have had an angle between the handle and the axis of the discharge openings which is greater than 90 degrees. Such an obtuse angle was used purportedly to eliminate the dripping problem, which it did not.

SUMMARY OF THE INVENTION

The present invention relates to side sprays of the type customarily used with kitchen faucets and has particular relation to such a side spray in which dripping from the discharge has been essentially eliminated.

Another purpose is a simply constructed reliable side spray of the type described which is more ergonomically suitable for use as a kitchen sink cleaning device.

Another purpose of the invention is to provide a side spray in which the discharge passage walls are so formed as to provide surface tension with any water therein, preventing the movement of such water out of the discharge openings except at such time as the discharge is connected to a source of water under pressure.

Other purposes will appear in the ensuing specification, drawings and claims.

BRIEF DESCRIPTION OF THE DRAWINGS

The invention is illustrated diagrammatically in the following drawings wherein:

FIG. 1 is an axial section through a side spray of the type described showing the side spray in the closed position;

FIG. 2 is an axial section, similar to FIG. 1, illustrating the side spray in the operated or "on" position;

FIG. 3 is an end view of the side spray discharge head;

FIG. 5 is an enlarged section illustrating the two members which form the water passages within the side spray; and FIG. 6 is a side view of the cone insert.

DESCRIPTION OF THE PREFERRED EMBODIMENT

Figure 4:
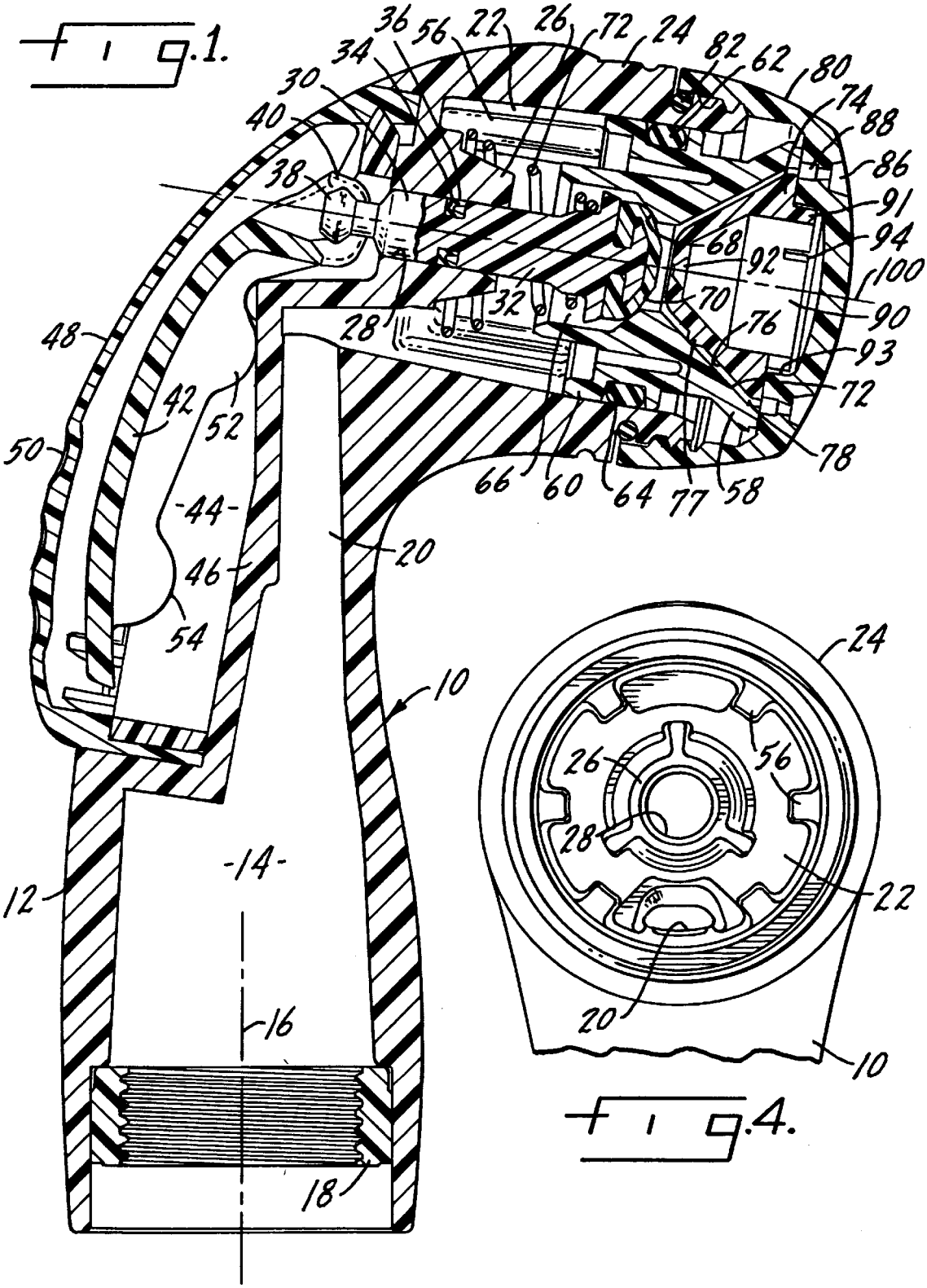
FIG. 4 is an end view of the cavity within the side spray, with the discharge elements removed.

The side spray as shown in section in FIG. 1 includes a body indicated generally at 10 which includes a handle 12.

The handle 12 has a water passage 14 and can be described as being essentially coaxial with an axis 16. A threaded nut 18 may be used to connect the side spray to a conventional water hose, which in turn will be connected to the kitchen faucet. The passage 14 terminates in a passage portion 20 which opens into a chamber 22 formed in the spray head portion 24 of the body 10.

Located within the chamber 22 is a boss 26 having a central passage 28 within which moves the stem 30 of a valve member or piston 32. The stem 30 includes a groove 34 within which is positioned a seal 36 to prevent water leaking outwardly from the chamber 22.

One end of stem 30 has a ball 38 which fits within the socket 40 of a trigger 42. The trigger 42 is movable within a recess 44 of the handle 12, which recess is formed by a wall 46. There is a flexible trigger cover 48 which extends over the trigger 42 and has depressions 50 which improve the gripping capabilities of the trigger cover.

The trigger 42 will pivot about the ball and socket connection with the stem of valve member 32. The trigger has extensions 52 and 54, with the extension 52 resting against wall 46 when the trigger is in the off position of FIG. 1, and both extensions 52 and 54 being against wall 46 when the trigger is in the on or operated position of FIG. 2. Squeezing of the flexible trigger guard will move the trigger from the FIG. 1 position to the FIG. 2 position.

Within the chamber 22 there are a plurality of axially extending fingers 56 which are effective to position a port member 58 shown in detail in FIG. 5. The port member 58 has an outer peripheral surface 60 which is in contact with the surface of chamber 22 and a seal ring 62 positioned within a groove 64 provides a seal between these two surfaces. The port member 58 has a cavity 66 terminating in a valve seat 68, with the flexible head 70 of piston 32 being held against seat 68 by a spring 72 when the valve is in the closed position of FIG. 1. The seating of piston 32 against seat 68 prevents any water from within chamber 22 reaching the discharge passages to be described. When the trigger is operated and moved to the position of FIG. 2, piston 32 will be moved by the trigger away from seat 68, thus placing the chamber 22 in communication with the discharge passages. Note the arrows 69 in FIG. 2 which show the path of water flow.

The port member 58 has a frustoconical cavity 72, the surface of which may have a texture so as to provide surface tension with any water passing thereby. The frustoconical cavity 72 positions a cone insert 74, which has an outer wall 76, matching the frustoconical configuration of cavity 72. The cone insert may have a plurality of spacing projections 77 which maintain the spacing between the cone insert and the frustoconical cavity, with this spacing defining a frustoconical discharge passage 78.

The spray head cover is indicated at 80 and may be threaded to the spray head 24 and there may be a seal ring 82 at the threaded joint. The spray head cover 80 has a plurality of peripherally arranged discharge openings 84, shown in FIG. 3, and in section in FIGS. 1 and 2. The discharge openings 84 have an enlarged exterior area 86 and a smaller passage area 88, with the passage area 88 being in communication with the frustoconical discharge passage 78 formed between the frustoconical cavity 72 of the port member and the exterior frustoconical surface of the cone insert 74. It should be understood that both facing walls of the discharge passage 78 may have a textured surface. The texture may be formed in any number of ways. It may be a pattern, it may be grooves, or it may be simply a roughened area. What is important is to provide both a textured surface and a sufficiently narrow space between the walls of passage 78 to utilize the inherent surface tension properties of water. The texture also provides a surface area increase per unit flow passage length. FIG. 6 illustrates the textured surface on wall 76 of the cone insert. One example of such a surface may be that designated as MT-1055-5 by the Mold-Tech Division of Roehlen Industries.

The cone insert 74 has an internal cavity 90 which, through an opening 92, is in communication with the area directly adjacent seat 68 and with the frustoconical discharge passage 78. The opening 92 allows water to flow into the cavity 90. The cone insert has an extension 91 which is seated within a recess 93 in the spray head cover 80. Water flows outwardly from the cavity 90 through a plurality of slots 94 in extension 91, there being three such slots, which permit the water to flow in the manner shown by the arrows 96 in FIG. 2 when the system is pressurized. Water will not drain from the slots 94 through small slot extensions 98 to the discharge openings 84 when the system is not operating due to the small size of the slots 94 and opening 92 working with the surface tension properties of water. This is advantageous in that it prevents water from dripping out of the spray head. Cone insert opening 92 and cavity 90 insure that no air will be trapped within water passage 78.

The axis of movement of valve member 32 is indicated at 100 and this axis forms an angle of slightly less than 90 degrees with the axis 16 of the handle 12. This is important as it provides a more ergonomically useful spray device if this angular relationship is present. In prior art spray devices the angle is normally greater than 90 degrees, which made the spray head slightly more difficult to use. The preferred angle is what is shown herein and this is only possible because of the provisions for preventing dripping from the discharge ports described herein.

When the trigger is initially operated and moved from the FIG. 1 position to the FIG. 2 position, water under pressure connected through the hose to the spray head will enter chamber 22 in the direction of the arrows shown in FIG. 2 and will pass around the head 70 of piston 32, past valve seat 68, and into the frustoconical discharge passage 78. From there it will flow out of the discharge openings 80 to provide a conventional spray discharge. When the trigger guard 48 is released and the trigger returns to the unoperated position of FIG. 1, there will be no further water flow. Because of the thin cross section of the frustoconical passage 78 and the textured walls which form this passage, there will be surface tension between the water remaining in the discharge passage and the walls of the passage. This surface tension will prevent water dripping out of the openings 84 even though the direction of such openings will be slightly downward when the spray head is placed on the kitchen deck. Although some water may remain within cavity 90 in the cone insert, this water will flow through the slots 94 and extensions 98 as shown by arrows 96 and will be immediately drained through the openings 84 as soon as the spray head is moved to the closed position. No further dripping can take place because of the above-described surface tension.

Whereas the preferred form of the invention has been shown and described herein, it should be realized that there may be many modifications, substitutions and alterations thereto.

The embodiments of the invention in which an exclusive property or privilege is claimed are defined as follows:

1. A spray device for use as an alternate water discharge to a faucet, said spray device including a body having a handle and spray head, said spray head having discharge opening means therein, a trigger movable on said body between an off position and an on position, a chamber within said body communicable with a source of water under pressure, water passage means between said chamber and said discharge opening means, valve means within said chamber and operable by movement of said trigger to connect the source of water under pressure, through said chamber, to said water passage means and said discharge opening means to provide a water discharge therefrom, said water passage means being formed between closely spaced facing walls at least one of which has a textured surface thereon to create adequate surface tension with water within said water passage means whereby water therein will not move to said discharge opening means unless said water passage means is connected to the source of water under pressure.

2. The spray device of claim 1 wherein both of said facing walls have a textured surface thereon.

3. The spray device of claim 1 wherein said water passage means have a frustoconical shape, with one end thereof being in communication with said discharge opening means and the other end thereof being in communication with said chamber.

4. The spray device of claim 3 wherein said discharge opening means includes a plurality of peripherally spaced openings, each being in communication with one end of said frustoconical water passage means.

5. The spray device of claim 1 wherein said valve means includes a valve seat located between said chamber and said water passage means, a valve member positioned to close upon said valve seat, and a spring within said chamber urging said valve member toward said valve seat.

6. The spray device of claim 5 including a movable connection between one end of said valve member and said trigger.

7. The spray device of claim 6 wherein said valve member moves along a predetermined axis when moving toward and away from said valve seat, said handle having an axis which defines the direction of said handle, with the angle between said handle axis and the axis of said valve member being slightly less than 90 degrees.

8. A spray device for use as an alternate water discharge to a faucet, said spray device including a body having a handle and spray head, said spray head having discharge opening means therein, a trigger movable on said body between an off position and an on position, a chamber within said body communicable with a source of water under pressure, water passage means between said chamber and said discharge opening means, valve means within said chamber and operable by movement of said trigger to connect the source of water under pressure, through said chamber, to said water passage means and said discharge opening means to provide a water discharge therefrom, said water passage means being formed between closely spaced facing walls having means thereon to create adequate surface tension with water within said water passage means whereby water therein will not move to said discharge opening means unless said water passage means is connected to the source of water under pressure, one wall of said water passage means being formed by a core insert having a frustoconical outer surface, a cavity in said core insert and an opening in said core insert connecting said cavity with said water passage means, the end of said core insert away from the opening therein having a plurality of drain slots to drain water from the core insert cavity toward said water passage means.

9. The spray device of claim 8 wherein the other wall of said water passage means is formed by a port member having a frustoconical cavity generally matching the frustoconical outer surface of said core insert.

10. The spray device of claim 9 including spacer means between said facing walls positioning said core insert relative to the frustoconical cavity of said port member.

11. The spray device of claim 10 wherein said spacing means are formed on the exterior of said core insert.

* * * * *